US007707759B2

(12) United States Patent
Roberts

(10) Patent No.: US 7,707,759 B2
(45) Date of Patent: May 4, 2010

(54) DEVICE FOR RETAINING A PLACARD WITHIN A PLACARD HOLDER, AND METHODS AND SYSTEMS THEREOF

(76) Inventor: Dwight Roberts, 7326 Pine Bower Ct., Humble, TX (US) 77346

( * ) Notice: Subject to any disclaimer, the term of this patent is extended or adjusted under 35 U.S.C. 154(b) by 766 days.

(21) Appl. No.: 10/593,906

(22) PCT Filed: Mar. 17, 2005

(86) PCT No.: PCT/US2005/009040

§ 371 (c)(1),
(2), (4) Date: Sep. 18, 2006

(87) PCT Pub. No.: WO2005/091256

PCT Pub. Date: Sep. 29, 2005

(65) Prior Publication Data

US 2007/0163161 A1 Jul. 19, 2007

Related U.S. Application Data

(60) Provisional application No. 60/554,075, filed on Mar. 17, 2004.

(51) Int. Cl.
*G09F 7/00* (2006.01)

(52) U.S. Cl. ..... 40/611.11; 40/590; 40/792

(58) Field of Classification Search ..... 40/794, 40/795, 793, 792, 790, 740, 661.1, 611.11, 40/611.09, 611.06, 340, 352, 588
See application file for complete search history.

(56) References Cited

U.S. PATENT DOCUMENTS 1,400,920 A * 12/1921 Stroud ..... 40/790
2,550,763 A * 5/1951 Bowder ..... 40/618
6,105,294 A * 8/2000 Goodfellow ..... 40/654.01

FOREIGN PATENT DOCUMENTS

WO 2005/091256 A1 9/2005

OTHER PUBLICATIONS

Patent Cooperation Treaty's Written Opinion of the International Searching Authority relating to International Application No. PCT/US05/09040, Aug. 11, 2005.
Patent Cooperation Treaty's International Search Report relating to International Application No. PCT/US05/09040, Aug. 11, 2005.
Response to Written Opinion Mailed Aug. 11, 2005 Under Article 34, Oct. 7, 2005, Houston.
Patent Cooperation Treaty's Note of Informal Communication with the Applicant, Nov. 9, 2005.

* cited by examiner

*Primary Examiner*—Caasandra Davis

(57) ABSTRACT

A retaining device for improving the functionality of placard holders when the placard holder is subject to transient atmospheric conditions. The retaining device includes a member used in conjunction with a placard holder to more fully secure a placard with the placard holder when transient atmospheric conditions are encountered. The retaining device may be adapted to use with many designs of placard holders, including, but not limited to, U.S. Department of Transportation approved hazardous material information placard holders.

5 Claims, 5 Drawing Sheets

DEVICE FOR RETAINING A PLACARD WITHIN A PLACARD HOLDER, AND METHODS AND SYSTEMS THEREOF

CROSS-REFERENCES TO RELATED APPLICATIONS

This application claims priority of the following U.S. Provisional Patent Application No. 60/554,075, filed Mar. 17, 2004.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The present invention relates to a device used to retain a placard within a placard holder.

2. Background Art

Placards are used in many situations to provide information to a reader about a particular material or device with which the placard is spatially related. The placard is usually positioned in such a manner that it is nearby or affixed to the package or container holding the thing described on the placard. Often, placards are placed within a holding device that is secured nearby, or on, the package or container. The advantage of the holding device is that it allows a placard to be changed when the contents of the associated package or container are changed. This is particularly useful where the placard holder is affixed to a refillable container such as a drum, railcar, shipping container, or the like.

Placards are also used as a source of information identifying the type of hazard a hazardous material in shipment may pose. This type of placard forms a component of an international system of hazard communication. Prominent display of the placard on shipping containers functions to immediately warn responders, handlers and bystanders that hazards are present and that caution should be taken when interacting with the container's contents. Therefore, it is critical that when such a placard is placed on a container that it remain firmly attached to the container throughout the time that the hazardous material is present.

Due to the standardized size and format of many hazardous material placards, the holders with which they are used must be designed so they do not obscure the information being displayed on the placard. This limitation restricts the available upper surface area of the placard that may be contacted by the placard holder for the purpose of restraining the placard within the holder. The placard holder is often comprised of a back frame member attached to the transport container and a front frame member having a flat surface portion enclosing an open window area. Such a placard holder is described in U.S. Pat. No. 4,229,891 to Keller, the disclosure of which is fully incorporated by this reference. In other prior art devices, the placard holder is as described in Keller, but without the locking arm, the outer lip, the locking tabs, and the ridges. Still further alternative prior art devices, the placard holder is as described in Keller, but the back frame is a surface of the vehicle/container such that the placard holder is permanently affixed to the vehicle/container. In yet further alternative prior art devices, the placard holder is as described in Keller, but without the locking arm, the outer lip, the locking tabs, and the ridges; and the back frame is a surface of the vehicle/container such that the placard holder is permanently affixed to the vehicle/container. The front and back frame members are usually peripherally bound by a spacing member that creates a placard pocket between the front and back frame members. At least some part of the periphery is left unbounded so as to allow access to the placard pocket. To facilitate ease of insertion and removal of the placards, the tolerances to which the placard holders are manufactured are large, usually resulting in excess space between the surfaces and edges of the placard and the placard holder.

However, when such placard holders are used on surfaces subject to atmospheric disturbances, whether natural or artificial, several problems have been identified. The atmospheric disturbance may be weather related, but is more often the result of the method by which the container on which the placard holder is placed is transported. For example, a tractor trailer vehicle pulling a tanker containing hydrochloric acid ("HCl") would be required to have hazardous material placards on both ends and both sides of the tanker identifying the contained material as HCl. However, when moving down the road at speeds often exceeding forty miles per hour (40 mph), the placards are subjected to winds at or near the speed at which the vehicle is traveling. This often results in air flow beneath the placard, causing it to shift within the placard holder. Even worse, the placard can lift away from the vehicle, become bent or broken, or otherwise damaged, thus limiting its ability to effectively convey the information contained on it.

What is needed is a placard holder that will restrict the movement of the placard within the placard holder, so that the placard substantially maintains its original position, no matter the atmospheric conditions to which it is subject.

BRIEF SUMMARY OF THE INVENTION

A system for restricting placard movement comprises a placard holder and a substantially planar member. The substantially planar member forms an opening, has an out-of-plane bend, and is inside the placard holder.

A method for restricting placard movement includes the steps of inserting a substantially planar member between a placard and a first surface of a placard holder; engaging the substantially planar member with the first surface of the placard holder; engaging the substantially planar member with the placard; and urging the placard against a second surface of the placard holder. The substantially planar member has an out-of-plane bend.

A retaining device for retaining a placard in a placard holder comprises a substantially planar member. The substantially planar member forms an opening, and has an out-of-plane bend, and urges the placard against the placard holder.

BRIEF DESCRIPTION OF THE SEVERAL VIEWS OF THE DRAWINGS

In the drawings the same members have the same reference numerals.

DETAILED DESCRIPTION OF THE INVENTION

Figure 1:
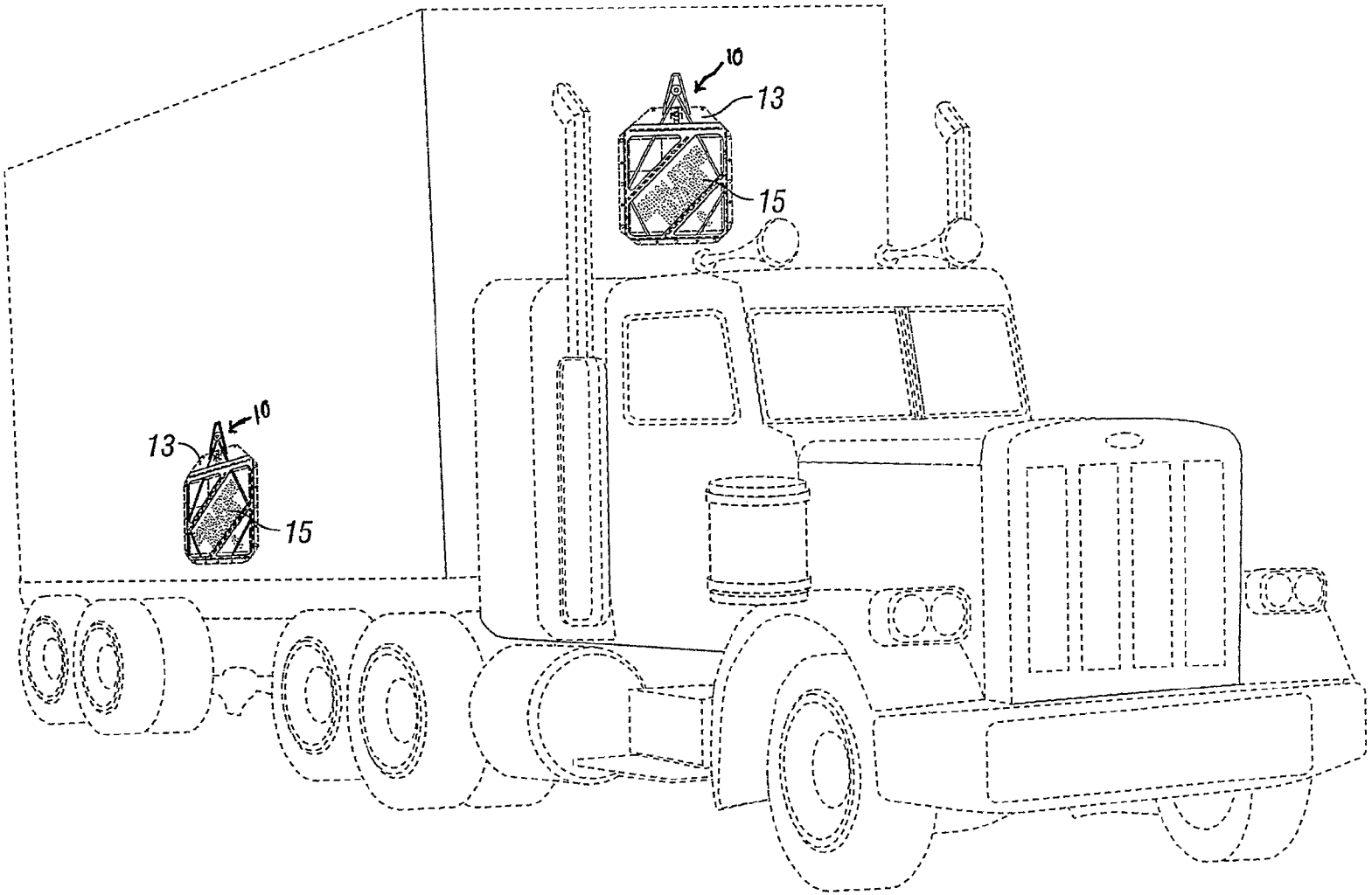
FIG. 1 is a prospective view of a retaining device inside a placard holder and mounted onto the outside of a vehicle.

FIG. 1 depicts a perspective view of a placard holder 13 mounted onto a vehicle. A retaining device 10 is inside the placard holder 13, and the retaining device 10 urges a placard 15 against the placard holder 13. In this manner the placard 15 remains relatively stationary within the placard holder 13.

Figure 2:
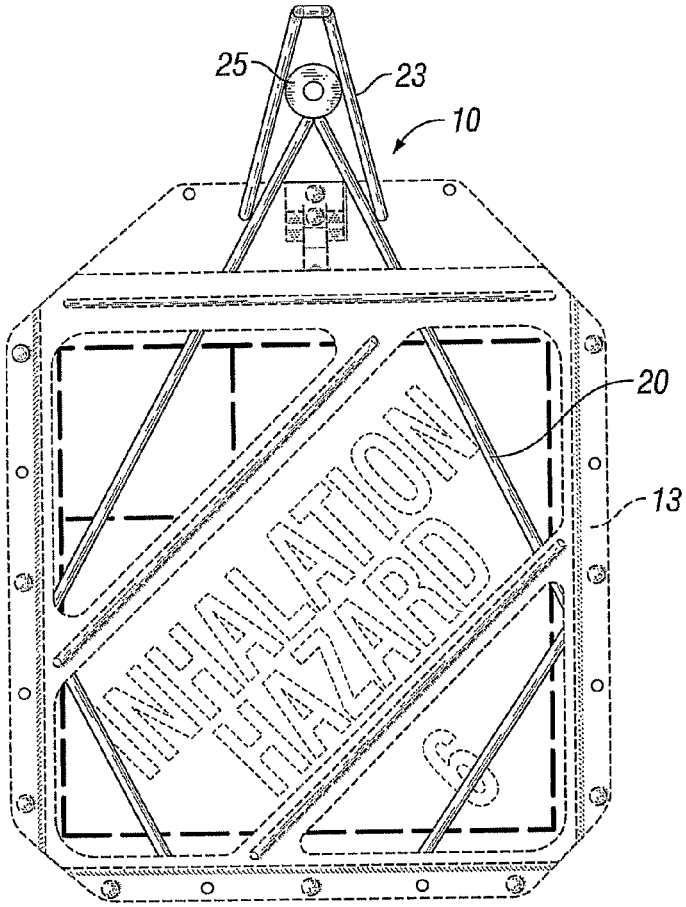
FIG. 2 is a front view of the retaining device of the present invention inside the placard holder.

Referring now to FIG. 2, the retaining device 10 includes a five-sided tubular polygon 20. The tubular polygon 20 should be of a weather-resistant and/or oxidation-resistant material. Suitable materials are selected from the group consisting of plastic, ultra-violet resistant plastic, steel, stainless steel, titanium, aluminum, and the like materials. However, in the preferred embodiment, the tubular polygon 20 is made of stainless steel having an outer thickness of between about two millimeters and about four millimeters. Firmly attached to the tubular polygon 20 is a bent A-frame 23 and a hollow disk 25. In alternative embodiments, however, the bent A-frame 23 and the hollow disk 25 are not necessary, and one or both of them can be absent. The bent A-frame 23 is made of a weather-resistant and/or oxidation-resistant material. Suitable materials are selected from the group consisting of plastic, ultra-violet resistant plastic, steel, stainless steel, titanium, aluminum, and the like materials. In the preferred embodiment, the bent A-frame 23 is made of stainless steel having an outer thickness of between about two millimeters and about four millimeters. The hollow disk 25 is made of a weather-resistant and/or oxidation-resistant material. Suitable materials are selected from the group consisting of plastic, ultra-violet resistant plastic, steel, stainless steel, titanium, aluminum, and the like materials. In the preferred embodiment the hollow disk 25 is made of stainless steel having an outer thickness of between about two millimeters and about four millimeters. In the preferred embodiment, the tubular polygon 20, bent A-frame 23, and hollow disk 25 are made of the same type of material. In alternative embodiments, the tubular polygon 20, bent A-frame 23, and hollow disk 25 are made from different materials. In still further embodiments, one of the following: the tubular polygon 20, bent A-frame 23, and hollow disk 25 is made from a different material than two of the following: the tubular polygon 20, bent A-frame 23, and hollow disk 25.

Preferably, the bent A-frame 23 is firmly attached to the outside of the tubular polygon 20. The bent A-frame 23 is firmly attached to the tubular polygon 20 by any of the means selected from the group consisting of welds, spot welds, molds, snaps, screws, nails, adhesive, and the like. Preferably, the hollow disk 25 is firmly attached on the outside of the tubular polygon 20. Alternatively, the hollow disk 25 is firmly attached on the inside of the tubular polygon 20 (not shown). The hollow disk 25 is firmly attached to the tubular polygon 20 by any of the means selected from the group consisting of welds, spot welds, molds, snaps, screws, nails, adhesive, and the like. Preferably, the bent A-frame 23 and the hollow disk 25 are firmly attached to the tubular polygon 20 by the same means. In an alterative embodiment, the bent A-frame 23 and the hollow disk 25 are firmly attached to the tubular polygon 20 by different means.

Figure 3:
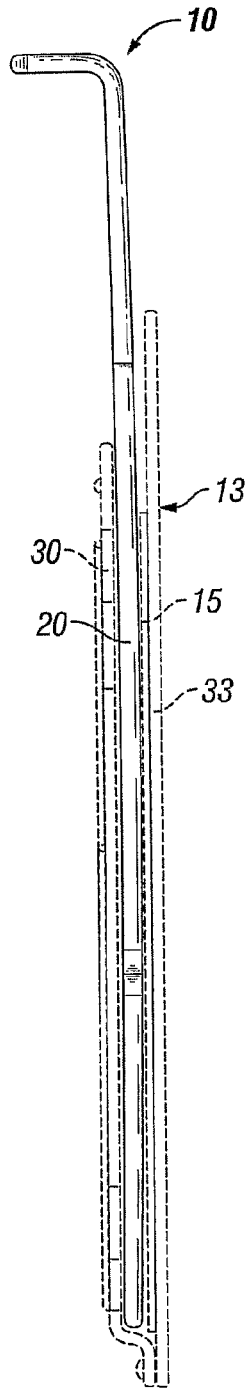
FIG. 3 is a side view of the retaining device of the present invention inside a placard holder.

FIG. 3 is a side view of the retaining device 10 inside the placard holder 13. hi FIG. 3 the retaining device 10 engages both a front frame 30 of the placard holder 13 and the placard 15. The phrase 'engages both the front frame 30 of the placard holder 13 and the placard 15' is defined as when at least a portion of the tubular polygon 20 contacts at least a portion of the front frame 30 of the placard holder 13, and at least a portion of the placard 15. A first surface is defined as at least a portion of the front frame 30. The retaining device 10 urges the placard 15 against a back frame 33 of the placard holder 13. The phrase 'urges the placard 15 against the back frame 33 of the placard holder 13' is defined as when at least a portion of the tubular polygon 20 contacts at least a portion of the placard 15. A second surface is defined as at least a portion of the back frame 33.

In an alternative embodiment, the retaining device 10 engages the placard 15 and the back frame 33 of the placard holder 13. The phrase, 'engages the placard 15 and the back frame 33 of the placard holder 13' is defined as when at least a portion of the tubular polygon 20 contacts at least a portion of the placard 15, and at least a portion of the back frame 33 of the placard holder 13. In this alternative embodiment, the retaining device 10 urges the placard 15 against the front frame 30 of the placard holder 13. The phrase, 'urges the placard 15 against the front frame 30 of the placard holder 13' is defined as when at least a portion of the tubular polygon 20 contacts the at least a portion of the placard 15.

It is preferred that the retaining device 10 urge the placard 15 against some portion of the placard holder 13 with a force sufficient to keep the placard 15 generally stationary, even in time of movement; however, the force should not so strong as to make it difficult to insert and remove the retaining device 10 and/or harm the placard 15.

Figure 4:
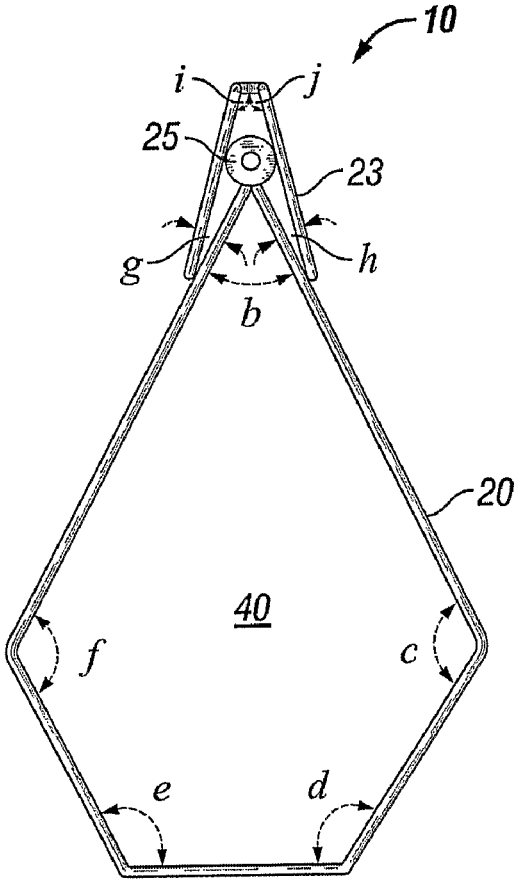
FIG. 4 is a front view of the retaining device of the present invention.

With reference to FIG. 4, the retaining device 10 forms an opening 40. Preferably, the opening 40 is of sufficient size and shape such that if printed materials were placed behind the opening 40 a person would be able to read and understand the printed materials i.e., the opening 40 allows a substantially unobstructed view of the information displayed on the placard (not shown in FIG. 4). The shape and size of the opening 40 is defined by the shape and size of the tubular polygon 20. FIG. 4 illustrates the tubular polygon 20 and opening 40 in the shape of a five-sided polygon; however, one of ordinary skill having the benefit of Applicant's disclosure would be able to derive alternative shapes. Accordingly, in various embodiments the tubular polygon 20 is described as a member, an annular member, a polygon member, a shaped member, a quadrilateral member, a circular member, a diamond member, a pentagon member, a hexagon member, a heptagon member, an octagon member, a nonagon member, a dodecagon member, and the like members, as well as members which substantially resemble those previously listed i.e., a substantially annular member.

Preferably, the tubular polygon 20 is substantially planar. The overall size of the tubular polygon 20 i.e., diameter, length, height, ect. will vary greatly depending on the size of the placard holder 13, and the size placard 15. Preferably, the outer-most length of the tubular polygon is about the same length as the outer-most length of the placard. Preferably, the outer-most length of the tubular polygon is less than the length of the outer-most length of the placard holder. Preferably, the outer-most height of the tubular polygon is greater than the outer-most height of the placard. Preferably, the outer-most height of the tubular polygon is greater than the outer-most height of the placard holder. In an alternative embodiment the outer-most height of the tubular polygon is about the same height as the outer-most height of the placard holder.

In the preferred embodiment, a square placard having a length of 27 centimeters is housed in a placard holder having an outer-most length of 30 centimeters and a outer-most height of 36 centimeters. The outer-most length of the tubular polygon is 26 centimeters, and the outer-most height of the tubular polygon is 37 centimeters.

Referring to the five-sided tubular polygon 20, the top angle b is acute. The top angle b is between about 45 degrees and about 65 degrees. The top angle b is 55 degrees. In an alternative embodiment the top angle b is between about 50 degrees and about 60 degrees. The next angle, rotating clockwise from the top angle b, is the right side angle c. The right side angle c is obtuse. The right side angle c is about 120 degrees. In an alternative embodiment the right side angle c is between about 110 degrees and about 130 degrees. The next angle, rotating clockwise from the right side angle c is the bottom right angle d. The bottom right angle d is obtuse. The bottom right angle d is about 120 degrees. In an alternative embodiment the bottom right angle d is between about 110 degrees and about 130 degrees. The next angle, rotating clockwise from the bottom right angle d, is the bottom left angle e. The bottom left angle e is obtuse. The bottom left angle e is 115 degrees. In an alternative embodiment the bottom left angle e is between about 105 degrees and about 130 degrees. The next angle, rotating clockwise from the bottom left angle e, is the left side angle f. The left side angle f is obtuse. The left side angle f is about 125 degrees. In an alternative embodiment the left side angle f is between about 115 degrees and about 135 degrees.

The bent A-frame 23 is firmly attached to a top end of the retaining device 10. In an alternative embodiment the bent A-frame 23 is attached to any distal end of the tubular polygon 20, and in a still further embodiment the bent A-frame 23 is attached to a location on the tubular polygon 20, which is not distal.

The bent A-frame 23 acts as a stiffening structure to prevent excessive deformation of the tubular polygon 20 when the retaining device 10 is inserted into the placard holder (not shown). Additionally, it is preferred that the stiffening structure is of a sufficient size and shape to act as a handle for a human hand. In an alternative embodiment, the bent A-frame 23 is not necessary, as in this embodiment, the material and shape of the tubular polygon 20 does not require reinforcement or stiffening.

Referring to the bent A-frame 23, the lower left angle g is acute. The lower left angle g is 15 degrees. In an alternative embodiment the lower left angle g is between about 10 degrees and about 20 degrees. The next angle, rotating clockwise from the lower left angle g, is the upper left angle i. The upper left angle i is obtuse. The upper left angle i is 105 degrees. hi an alternative embodiment the upper left angle i is between about 100 degrees and about 110 degrees. The next angle, rotating clockwise from the upper left angle i, is the upper right angle j. The upper right angle j is obtuse. The upper right angle j is 105 degrees. In an alternative embodiment the upper right angle j is between about 100 degrees and about 110 degrees. The next angle, rotating clockwise from the upper right angle j, is the lower right angle h. The lower right angle h is acute. The lower right angle h is 15 degrees. In an alternative embodiment the lower right angle h is between about 10 degrees and about 20 degrees.

The hollow disk 25 is in the shape of a hollow disk. However, the hollow disk 25 can be an annulus, any polygon, a quadrilateral, a circle, a diamond-shaped, a pentagon, a hexagon, a heptagon, an octagon, a nonagon, or a dodecagon. Preferably, the hollow disk 25 is used to store and/or hang the retaining device 10 when the retaining device 10 is not inside the placard holder.

Figure 5:
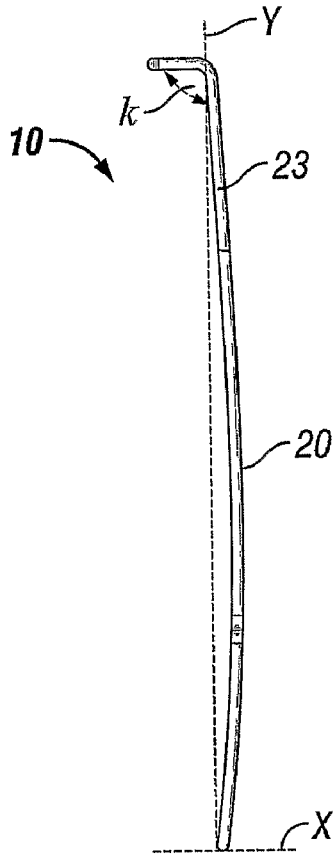
FIG. 5 is a side view of the retaining device of the present invention.

FIG. 5 depicts a side view of the retaining device 10. The retaining device 10 has an out-of-plane bend, which can be seen in FIG. 5 with respect to reference-line Y. The out-of-plane bend is substantially in a direction along the reference-line X. The out-of-plane bend allows the tubular polygon 20 to act as a spring when between two planar surfaces (not shown). In an embodiment the out-of-plane bend of the tubular polygon 20 maintains the placard 15 in a stationary position during ambient conditions such that the locking arm, the outer lip, the locking tabs, and the ridges of the placard are not necessary, and may be absent from the placard.

In an alternative embodiment, the retaining device has an out-of-plane bend, which is so slight that it does not act as a spring. In this embodiment, the retaining device acts as a spacer to impart a sufficient amount of force against the placard to keep the placard generally stationary.

FIG. 5 additionally depicts a side view of the bent A-frame 23. The bent A-frame 23 has a bend at its distal end in a direction along reference-line X. The bent A-frame 23 is bent in a direction substantially opposite to the direction in which the out-of-plane bend is directed. The angle of the bend k is a right angle, i.e., 90 degrees. In alterative embodiments the angle of the bend k ranges from between about 135 degrees and about 45 degrees. In yet another embodiment the angle of the bend k ranges from between about 113 degrees and about 68 degrees. In a still further embodiment the angle of the bend k ranges from between about 100 degrees and about 80 degrees.

Figure 6:
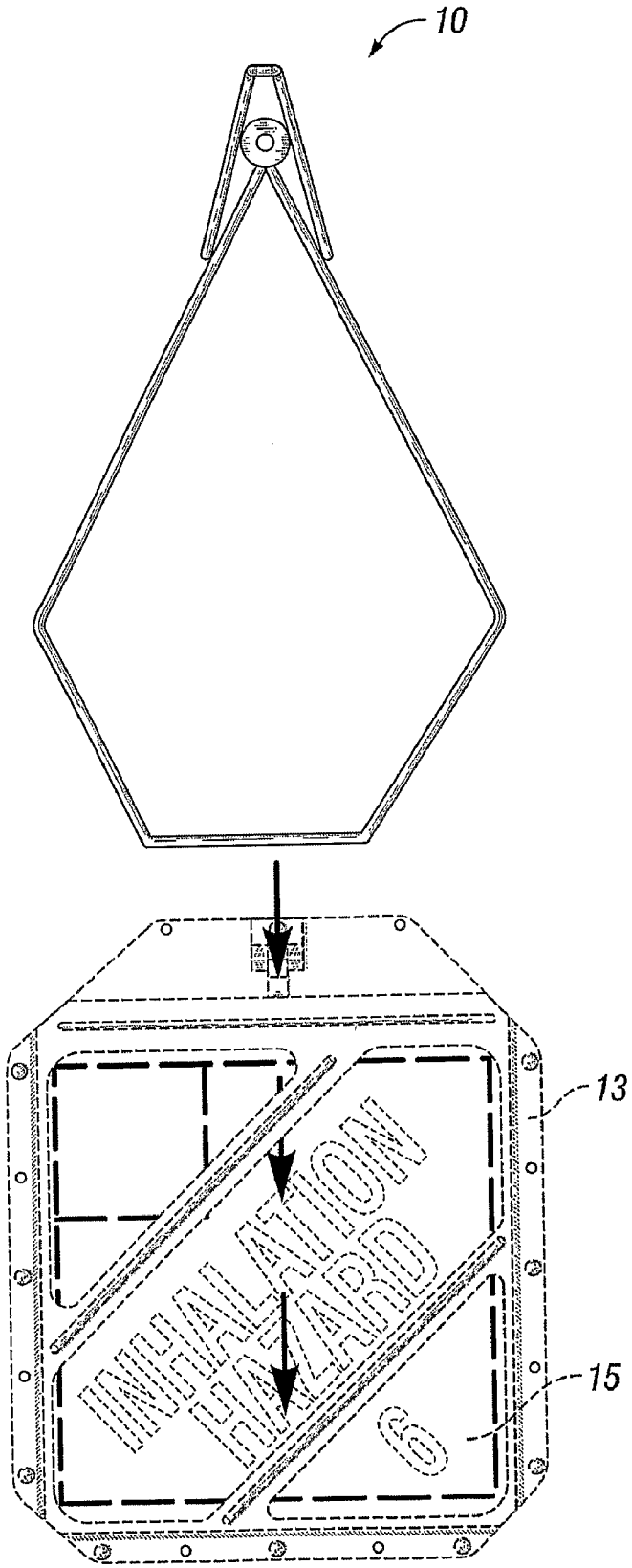
FIG. 6 is a front view of the retaining device of the present invention depicting the method of insertion of the retaining device in the placard holder.

FIG. 6 illustrates a preferred method of inserting the retaining device 10 into the placard holder 13. The retaining device 10 is inserted through the same aperture of the placard holder 13 that is used to insert a placard 15. In an alternative embodiment, the retaining device 10 is inserted through a different aperture (not shown) of the placard holder 13 that is used to insert the placard 15.

Figure 7:
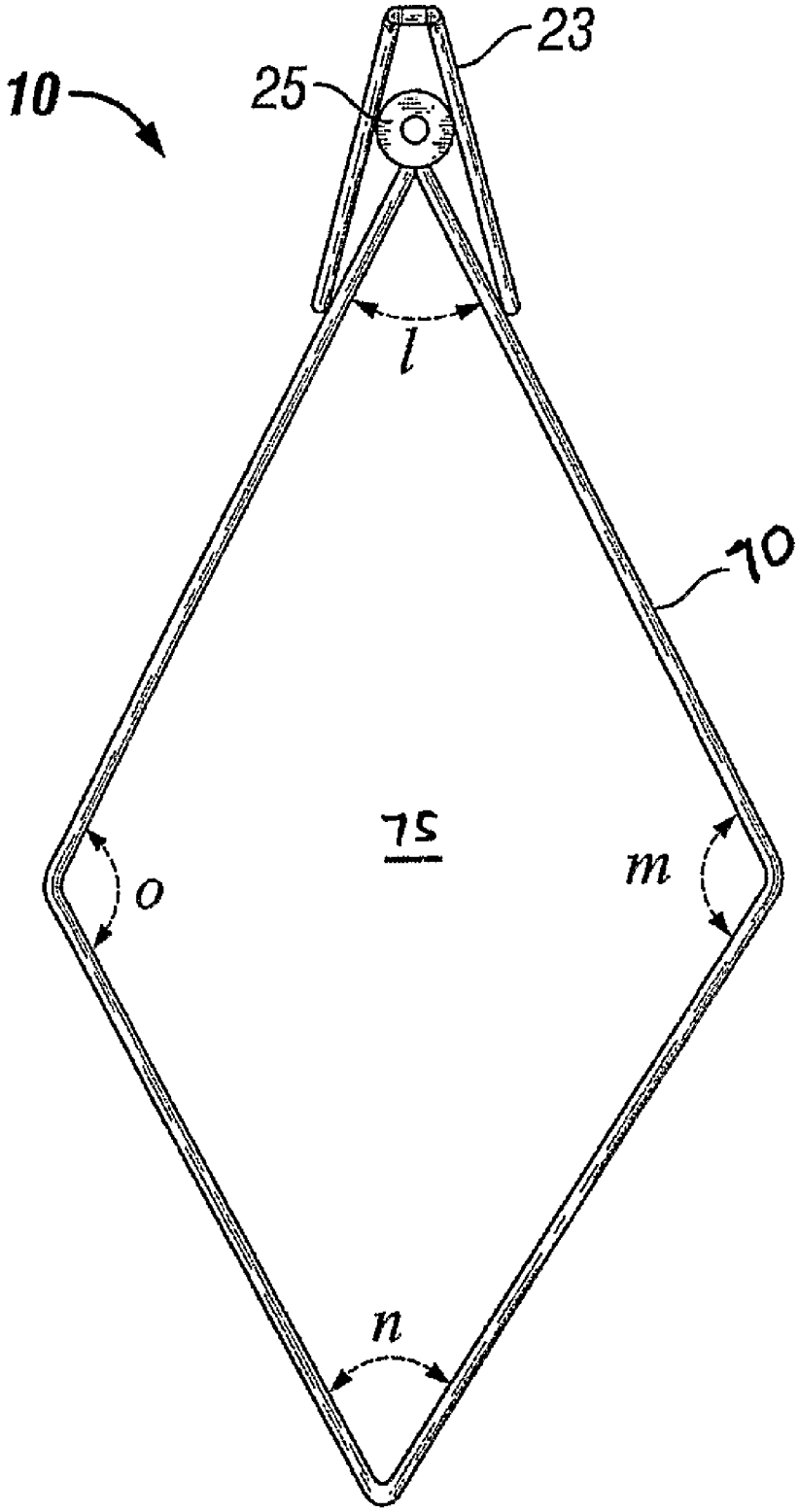
FIG. 7 is a front view of an alternative embodiment of the retaining device of the present invention.

FIG. 7 illustrates the retaining device 10, which includes a tubular polygon 70 that is in a shape alternative to that depicted in FIG. 4. The tubular polygon 70 of FIG. 7 is in a diamond shape. Accordingly, the opening 75 is also in the shape of a diamond. The above disclosure regarding the tubular polygon 20 applies to the tubular polygon 70 of FIG. 7, except for the above disclosed angles with reference to FIG. 4.

The following angles are recited with reference to the diamond shaped polygon in FIG. 7. The summit angle 1 is obtuse. The summit angle 1 is 125 degrees. In an alternative embodiment the summit angle 1 is between about 120 degrees and about 130 degrees. Preferably, the next angle, rotating clockwise from the summit angle 1, is the east side angle m. The east side angle m is obtuse. The east side angle m is 120 degrees. In an alternative embodiment the east side angle m is between about 115 degrees and about 130 degrees. The next angle, rotating clockwise from the east side angle m, is the trough angle n. The trough angle n is obtuse. The trough angle n is 115 degrees. In an alternative embodiment the trough angle n is between about 100 degrees and about 120 degrees. The next angle, rotating clockwise from the trough angle n, is the west side angle o. The west side angle o is obtuse. The west side angle o is about 125 degrees. In an alternative embodiment the west side angle o is between about 120 degrees and about 130 degrees.

The above disclosure regarding the bent A-frame 23 applies as appropriate to the bent A-frame 23 of FIG. 7. The above disclosure regarding the hollow disk 25 applies as appropriate to the hollow disk 25 of FIG. 7.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A retaining device for retaining a placard in a placard holder comprising:

a substantially planar member, wherein the substantially planar member forms an opening, and has an out-of-plane bend, wherein the substantially planar member urges the placard against the placard holder, wherein a stiffening structure is attached to the substantially planar member, wherein an inner member is attached to the substantially planar member, and wherein the inner member and the stiffening structure are attached to the substantially planer member at a same proximate end.

2. The retaining device of claim 1, wherein, the shape of the substantially planar member is selected from the group consisting of a substantially annular member, a substantially polygon member, a substantially shaped member, a substantially quadrilateral member, a substantially circular member, a substantially diamond member, a substantially pentagon member, a substantially hexagon member, a substantially heptagon member, a substantially octagon member, a substantially nonagon member, and a substantially dodecagon member;

the shape of the inner member is selected from the group consisting of a substantially annular inner member, a substantially polygon inner member, a substantially shaped inner member, a substantially quadrilateral inner member, a substantially circular inner member, a substantially diamond inner member, a substantially pentagon inner member, a substantially hexagon inner member, a substantially heptagon inner member, a substantially octagon inner member, a substantially nonagon inner member, and a substantially dodecagon inner member.

3. The retaining device of claim 2, wherein the material of the substantially planar member, inner member, and stiffening structure is independently selected from the group consisting of plastic, ultra-violet resistant plastic, steel, stainless steel, titanium, and aluminum.

4. The retaining device of claim 3, wherein the inner member and the stiffening structure are attached to the substantially planar member by independent means selected from the group consisting of welds, spot welds, molds, snaps, screws, nails, and adhesives.

5. The retaining device of claim 4, wherein the stiffening structure has a bend in its distal end that extends in a direction opposite to the direction that the out-of-plane bend of the substantially planar member extends.

* * * * *